US010132556B2

(12) United States Patent
McKinney

(10) Patent No.: US 10,132,556 B2
(45) Date of Patent: Nov. 20, 2018

(54) DISPENSING ASSEMBLY FOR A REFRIGERATOR APPLIANCE

(71) Applicant: General Electric Company, Schenectady, NY (US)

(72) Inventor: Gloria Faye McKinney, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 288 days.

(21) Appl. No.: 14/842,019

(22) Filed: Sep. 1, 2015

(65) Prior Publication Data

US 2017/0057803 A1 Mar. 2, 2017

(51) Int. Cl.

| | |
|---|---|
| ***B67D 1/08*** | (2006.01) |
| ***F25D 23/02*** | (2006.01) |
| ***F25D 23/12*** | (2006.01) |

(52) U.S. Cl.

CPC ..... *F25D 23/12* (2013.01); *F25D 2323/122* (2013.01); *F25D 2400/02* (2013.01)

(58) Field of Classification Search

CPC ..... F25D 23/12; F25D 2323/122; F25D 2323/121; A47J 31/465

USPC ..... 99/295, 300, 302 R, 307; 392/441, 447, 392/449, 451, 455; 222/146.2, 195

See application file for complete search history.

(56) References Cited

U.S. PATENT DOCUMENTS

| | | | | |
|---|---|---|---|---|
| 3,677,288 | A * | 7/1972 | Martin | F16K 31/36 137/501 |
| 8,846,121 | B2 | 9/2014 | Hansen et al. | |
| 2010/0024658 | A1* | 2/2010 | Jacobs | A47J 31/46 99/302 R |
| 2011/0151075 | A1 | 6/2011 | Peterson | |
| 2013/0209636 | A1* | 8/2013 | Cominelli | A47J 31/46 426/431 |
| 2014/0238245 | A1* | 8/2014 | Yui | A47J 31/465 99/280 |

* cited by examiner

*Primary Examiner* — Dana Ross
*Assistant Examiner* — James Sims, III
(74) *Attorney, Agent, or Firm* — Dority & Manning, P.A.

(57) ABSTRACT

A dispenser for a refrigerator appliance includes a liquid outlet conduit that extends from a tank. An air conduit extends to the liquid outlet conduit, and an air pump is coupled to the air conduit. The air pump is configured for selectively pumping air into a flow of liquid in the liquid outlet conduit. A related method for operating a dispenser of a refrigerator appliance is also provided.

14 Claims, 3 Drawing Sheets

DISPENSING ASSEMBLY FOR A REFRIGERATOR APPLIANCE

FIELD OF THE INVENTION

The present subject matter relates generally to refrigerator appliances and dispensing assemblies for the same.

BACKGROUND OF THE INVENTION

Certain refrigerator appliances include a dispenser for directing ice from the refrigerator's ice maker and/or liquid water to the dispenser. A user can activate the dispenser to direct a flow of ice or liquid water into a cup or other container positioned within the dispenser. Liquid water directed to the dispenser is generally chilled or at an ambient temperature. However, certain refrigerator appliances also include features for dispensing heated liquid water.

Heated liquid water can be used to make certain beverages, such as coffee or tea. Refrigerators equipped to dispense heated liquid water can assist with making such beverages. However, certain hot drinks, such as cocoa or hot chocolate, are not brewed but rather mixed with heated water to make the hot drink. Brewed hot drinks are generally filtered to contain the leaves or grinds used to brew the hot drink. However, filtering mixed hot drinks is undesirable as filtering can interfere with mixing of the powder with the heated water.

Single serving beverage dispensers utilize pumps to create pressure that drives liquid into and through a chamber. The use of such pumps to drive liquid into and through the chamber during a brew cycle can cause unpredictable liquid flow rate variations, which can lead to unpredictable contact time for the liquid in the single serve dispensers and resulting decreases in beverage quality.

Accordingly, methods and apparatus for dispensing heated water and for controlling a flow rate of liquid to a single serve dispenser would be advantageous. In particular, methods and apparatus for dispensing heated water and for controlling a flow rate of liquid flowed while also assisting with mixing of powdered beverage mix in a single serve beverage dispenser would be useful.

BRIEF DESCRIPTION OF THE INVENTION

The present subject matter provides a dispenser for a refrigerator appliance. The dispenser includes a liquid outlet conduit that extends from a tank. An air conduit extends to the liquid outlet conduit, and an air pump is coupled to the air conduit. The air pump is configured for selectively pumping air into a flow of liquid in the liquid outlet conduit. A related method for operating a dispenser of a refrigerator appliance is also provided. Additional aspects and advantages of the invention will be set forth in part in the following description, or may be apparent from the description, or may be learned through practice of the invention.

In a first exemplary embodiment, a dispenser for a refrigerator appliance is provided. The dispenser includes a tank and a heating element configured for heating fluid within the tank. A liquid inlet conduit extends to the tank. The liquid inlet conduit is configured for receiving a flow of liquid and directing the flow of liquid into the tank. An inlet valve is coupled to the liquid inlet conduit. The inlet valve is configured for regulating the flow of liquid into the tank via the liquid inlet conduit. A liquid outlet conduit extends from the tank. The liquid outlet conduit is configured for directing the flow of liquid out of the tank. An air conduit extends to the liquid outlet conduit. An air pump is coupled to the air conduit. The air pump is configured for selectively pumping air into the flow of liquid in the liquid outlet conduit.

In a second exemplary embodiment, a method for operating a dispenser of a refrigerator appliance is provided. The method includes receiving a heated water dispense signal at a controller of the refrigerator appliance, activating a heating element of the dispenser, opening an inlet valve coupled to a liquid inlet conduit of the dispenser in order to initiate a flow of heated water from a tank of the dispenser, and operating an air pump coupled to an air conduit of the dispenser such that the air pump urges a flow of air into the flow of heated water from the tank of the dispenser.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
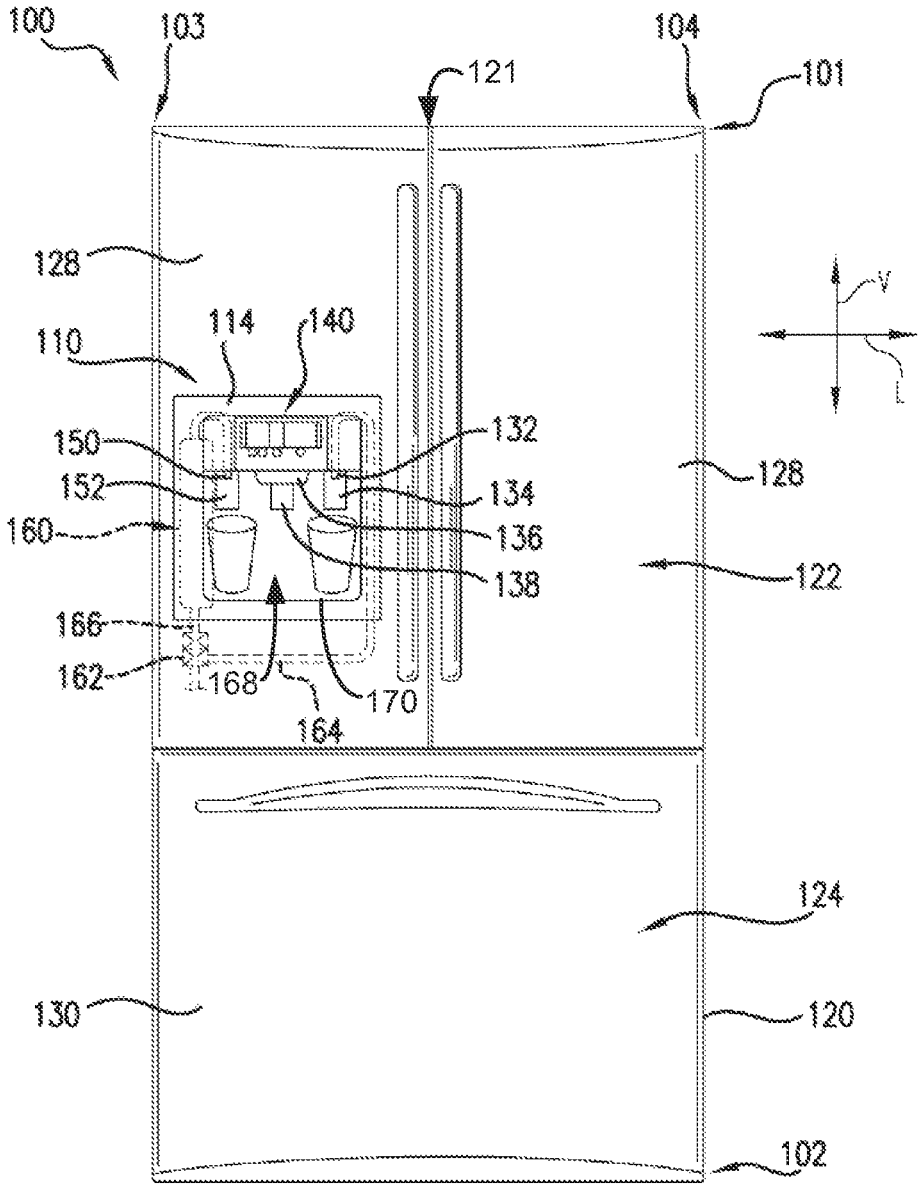
FIG. 1 provides a front, elevation view of a refrigerator appliance according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 provides a front, elevation view of a refrigerator appliance 100 according to an exemplary embodiment of the present subject matter. Refrigerator appliance 100 includes a cabinet or housing 120. Housing 120 extends between an upper portion 101 and a lower portion 102 along a vertical direction V and also extends between a first side portion 103 and a second side portion 104 along a lateral direction L. Housing 120 defines chilled chambers, e.g., a fresh food compartment 122 positioned adjacent upper portion 101 of housing 120 and a freezer compartment 124 arranged at lower portion 102 of housing 120. Housing 120 also defines a mechanical compartment (not shown) for receipt of a sealed cooling system for cooling fresh food compartment 122 and freezer compartment 124.

Refrigerator appliance 100 is generally referred to as a bottom mount refrigerator appliance. However, it should be understood that refrigerator appliance 100 is provided by way of example only. Thus, the present subject matter is not limited to refrigerator appliance 100 and may be utilized in any suitable refrigerator appliance. For example, one of skill in the art will understand that the present subject matter may be used with side-by-side style refrigerator appliances or top mount refrigerator appliances as well.

Refrigerator doors 128 are rotatably hinged housing 120, e.g., at an opening 121 that permits access to fresh food compartment 122, in order to permit selective access to fresh food compartment 122. A freezer door 130 is arranged below refrigerator doors 128 for accessing freezer compartment 124. Freezer door 130 is mounted to a freezer drawer (not shown) slidably coupled within freezer compartment 124.

Refrigerator appliance 100 also includes a water-dispensing assembly 110 for dispensing liquid water and/or ice to a dispenser recess 168 defined on one of refrigerator doors 128. Water-dispensing assembly 110 includes a dispenser 114 positioned on an exterior portion of refrigerator appliance 100. Dispenser 114 includes several outlets for accessing ice, chilled liquid water, and heated liquid water. As will be understood by those skilled in the art, liquid water from a water source, such as a well or municipal water system, can contain additional substances or matter. Thus, as used herein, the term "water" includes purified water and solutions or mixtures containing water and, e.g., elements (such as calcium, chlorine, and fluorine), salts, bacteria, nitrates, organics, and other chemical compounds or substances.

To access ice, chilled liquid water, and heated liquid water, water-dispensing assembly 110 includes a chilled water paddle 134 mounted below a chilled water outlet 132 for accessing chilled liquid water and a heated water paddle 152 mounted below a heated water outlet 150 for accessing heated liquid water. Similarly, an ice paddle 138 is mounted below an ice outlet 136 for accessing ice. As an example, a user can urge a vessel such as a cup against any of chilled water paddle 134, heated water paddle 152, and/or ice paddle 138 to initiate a flow of chilled liquid water, heated liquid water, and/or ice into the vessel within dispenser recess 168, respectively.

A control panel or user interface panel 140 is provided for controlling the mode of operation of dispenser 114, e.g., for selecting crushed or whole ice. In additional exemplary embodiments, refrigerator appliance 100 may include a single outlet and paddle rather than three separate paddles and dispensers. In such embodiments, user interface panel 140 can include a chilled water dispensing button (not labeled), an ice-dispensing button (not labeled), a heated water dispensing button (not labeled) for selecting between chilled liquid water, ice and heated liquid water, respectively.

Outlets 132, 136, and 150 and paddles 134, 138, and 152 are an external part of dispenser 114, and are positioned at or adjacent dispenser recess 168, e.g., a concave portion defined in an outside surface of refrigerator door 128. Dispenser 114 is positioned at a predetermined elevation convenient for a user to access ice or liquid water, e.g., enabling the user to access ice without the need to bend-over and without the need to access freezer compartment 124. In the exemplary embodiment, dispenser 114 is positioned at a level that approximates the chest level of a user.

Refrigerator appliance 100 also includes features for generating heated liquid water and directing such heated liquid water to dispenser recess 168. Thus, refrigerator appliance 100 need not be connected to a residential hot water heating system in order to supply heated liquid water to dispenser recess 168. In particular, refrigerator appliance 100 includes a water heating assembly 160 mounted within refrigerator door 128 for heating water therein. Refrigerator appliance 100 includes a tee-joint 162 for splitting a flow of water. Tee-joint 162 directs water to both a heated water conduit 166 and a chilled water conduit 164.

Heated water conduit 166 is in fluid communication with water heating assembly 160 and heated water outlet 150. Thus, water from tee-joint 162 can pass through water heating assembly 160 and exit refrigerator appliance 100 at heated water outlet 150 as heated liquid water. Conversely, chilled water conduit 164 is in fluid communication with chilled water outlet 132. Thus, water from tee-joint 162 can exit refrigerator appliance 100 as chilled liquid water at chilled water outlet 132. In alternative exemplary embodiments, chilled water conduit 164 and heated water conduit 166 are joined such that chilled and heated water conduits 164 and 166 are connected in parallel or in series to each other and dispense fluid at dispenser recess 168 from a common outlet.

Figure 2:
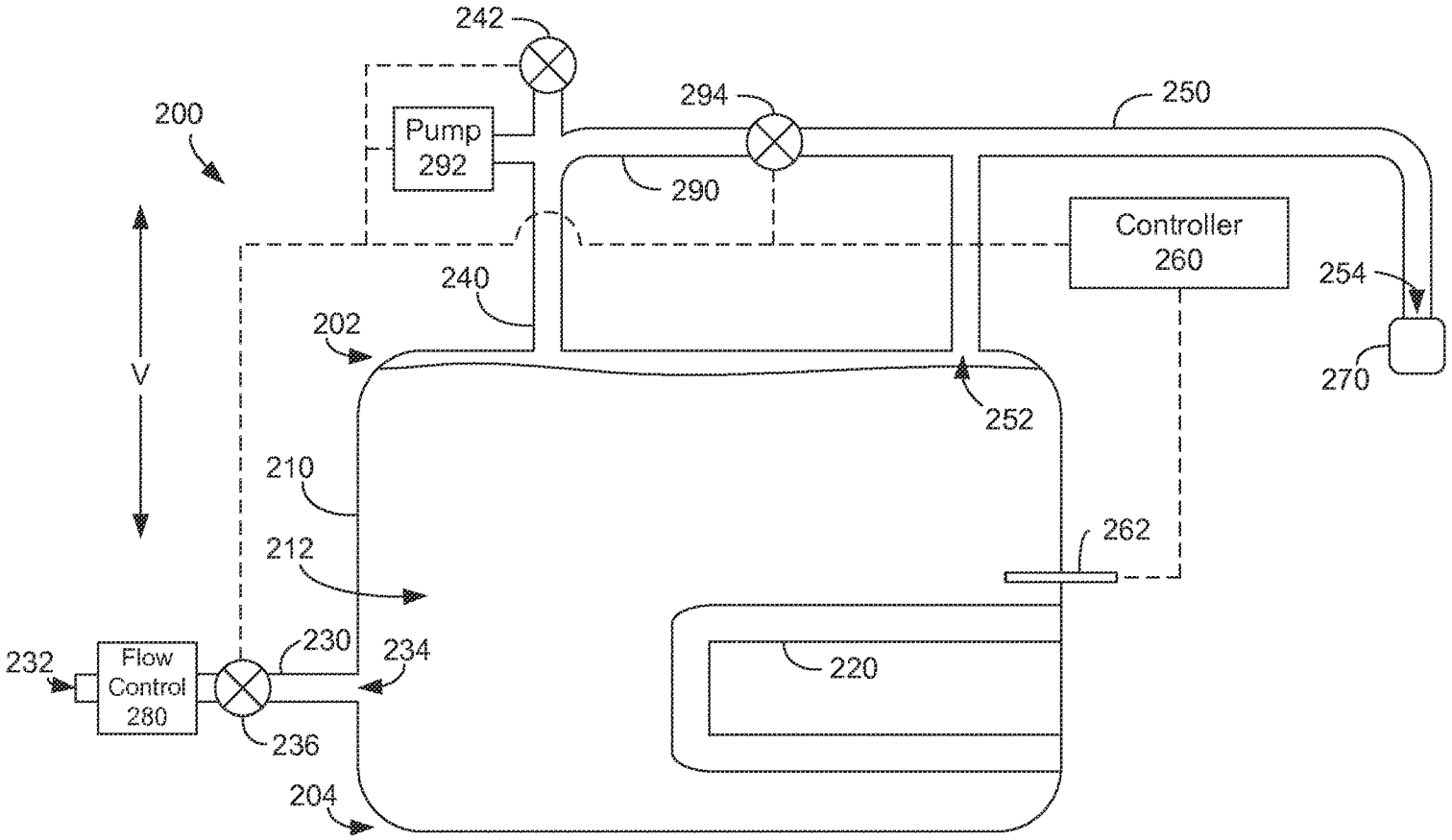
FIG. 2 provides a schematic view of a dispensing assembly according to an exemplary embodiment of the present subject matter.

FIG. 2 provides a schematic view of a dispensing assembly 200 according to an exemplary embodiment of the present subject matter. As discussed in greater detail below, dispensing assembly 200 is configured for generating and dispensing heated liquid water in a refrigerator appliance. Dispensing assembly 200 can be used in any suitable refrigerator appliance. For example, dispensing assembly 200 may be used in refrigerator appliance 100 (FIG. 1) as water heating assembly 160. Thus, dispensing assembly 200 is discussed in greater detail below in the context of refrigerator appliance 100. As discussed in greater detail below, dispensing assembly 200 is configured for dispensing heated liquid water in order to brew or mix heated beverages at dispenser recess 168 of refrigerator appliance 100 (FIG. 1).

As may be seen in FIG. 2, dispensing assembly 200 includes a reservoir or tank 210. Tank 210 defines a fluid chamber 212. As discussed in greater detail below, fluid chamber 212 is configured for receiving fluid, such as liquid water, and containing heated liquid water during operation of a heating element 220 of dispensing assembly 200.

Heating element 220 is configured for heating fluid, such as liquid water, within fluid chamber 212 of tank 210. Heating element 220 may be mounted to tank 210 and positioned within or adjacent fluid chamber 212 of tank 210. Heating element 220 can be any suitable mechanism for heating fluid within fluid chamber 212 of tank 210. For example, heating element 220 may be an electric resistance heating element, a microwave heating element, a gas burner, or an induction heating element in certain exemplary embodiments. As shown in FIG. 2, heating element 220 may be disposed or immersed within liquid, such as liquid water, in fluid chamber 212.

Dispensing assembly 200 also includes an inlet conduit 230 and a liquid outlet conduit 250. Inlet conduit 230 is configured for directing liquid into fluid chamber 212 of tank 210. Inlet conduit 230 extends between an inlet or entrance 232 and an outlet or exit 234. Entrance 232 of inlet conduit 230 is in fluid communication with a water supply (not shown), such as a well or municipal water source. Exit 234 of inlet conduit 230 is mounted to tank 210 or positioned at or adjacent tank 210 such that exit 234 of inlet conduit 230 is in fluid communication with fluid chamber 212 of tank 210. Thus, liquid from the water supply can flow through inlet conduit 230 into fluid chamber 212 of tank 210.

Liquid outlet conduit 250 is configured for directing liquid out of fluid chamber 212 of tank 210, e.g., to dispenser recess 168 of water-dispensing assembly 110 (FIG. 1). Liquid outlet conduit 250 extends between an inlet or entrance 252 and an outlet or exit 254. Entrance 252 of liquid outlet conduit 250 is mounted to tank 210 or positioned at or adjacent tank 210 such that entrance 252 of liquid outlet conduit 250 is in fluid communication with fluid chamber 212 of tank 210. Exit 254 of liquid outlet conduit 250 is positioned at or adjacent dispenser recess 168 of water-dispensing assembly 110. Thus, fluid from tank 210 can flow through liquid outlet conduit 250 to dispenser recess 168 of water-dispensing assembly 110. In particular, liquid water from fluid chamber 212 can flow through liquid outlet conduit 250 to dispenser recess 168 of water-dispensing assembly 110.

Dispensing assembly 200 also includes an inlet valve 236. Inlet valve 236 is configured for regulating a flow of liquid through inlet conduit 230 into fluid chamber 212 of tank 210. Inlet valve 236 can be any suitable mechanism for regulating fluid flow. For example, inlet valve 236 may be a solenoid valve. Inlet valve 236 can be mounted to any suitable component of dispensing assembly 200. For example, inlet valve 236 may be mounted to inlet conduit 230. As another example, inlet valve 236 may be mounted to tank 210.

Dispensing assembly 200 further includes a venting conduit 240. Venting conduit 240 extends from tank 210 such that a flow of fluid, e.g., steam or air, may exit fluid chamber 212 of tank 210 via venting conduit 240. A venting valve 242 is coupled to venting conduit 240. Venting valve 242 is configured for regulating a flow of gas out of tank 210 to ambient atmosphere via venting conduit 240. Thus, venting valve 242 may be selectively opened or closed in order to vent fluid chamber 212 of tank 210 to ambient atmosphere about dispensing assembly 200. Venting valve 242 can be any suitable mechanisms for regulating fluid flow. For example, venting valve 242 may be a solenoid valve.

Dispensing assembly 200 also includes a pod beverage brewing module or single serve dispenser module 270, e.g., positioned at or adjacent dispenser recess 168 of refrigerator appliance 100 and fluidly coupled to liquid outlet conduit 250. Single serve dispenser module 270 may receive a pod or container with a predetermined amount of a substance to be mixed or brewed with a suitable liquid, such as water, etc. For example, coffee, tea, chocolate, or other suitable consumable substances may be disposed within the container in single serve dispenser module 270. A top cover of the container may enclose an opening of the container, and may be puncturable and/or removable to access the substance therein. For example, in some embodiments, the top cover may be formed from a suitable foil material, such as aluminum foil. A liquid, such as heated water from tank 210 via liquid outlet conduit 250, may be introduced into single serve dispenser module 270, and the liquid may mix or brew with the substance within the container in single serve dispenser module 270, to provide the desired beverage.

Dispensing assembly 200 further includes a flow control device 280 coupled to inlet conduit 230. Flow control device 280 is generally upstream of and in fluid communication with outlet 254 of liquid outlet conduit 250. In certain exemplary embodiments, flow control device 280 is disposed upstream of inlet valve 236, e.g., such that liquid in inlet conduit 230 flows through flow control device 280 prior to inlet valve 236 and tank 210. However, in alternative exemplary embodiments, flow control device 280 may be disposed between inlet valve 236 and tank 210 on inlet conduit 230. In other alternative exemplary embodiments, flow control device 280 may be downstream of tank 210 on liquid outlet conduit 250 or at any other suitable location within dispensing assembly 200.

Flow control device 280 alters various flow characteristics of liquid flowing therethrough, such that liquid output from flow control device 280 is at a generally constant pressure. By supplying liquid from flow control device 280 at a generally constant pressure, the back pressure in dispensing assembly 200 may be regulated, such that a flow rate of liquid within liquid outlet conduit 250 into single serve dispenser module 270 is regulated at a generally constant flow rate. Further, due to use of a flow control device 280 in dispensing assembly 200, liquid and/or air pumps are not required for flow through liquid outlet conduit 250 into single serve dispenser module 270. However, as discussed in greater detail below, dispensing assembly 200, includes an air pump 292 for directing a flow of air into liquid within liquid outlet conduit 250 in order to improve performance of single serve dispenser module 270.

As discussed above, dispensing assembly 200 may receive a flow of pressurized water (e.g., relative to ambient atmosphere about dispensing assembly 200) to provide water to and operate single serve dispenser module 270. Pressurized water may be supplied from any suitable source to dispensing assembly 200, such as a municipal water supply or a well. Utilizing flow control device 280 may assist with conditioning or regulating the pressurized water.

Flow control device 280 may be any suitable mechanism for conditioning fluid flow therethough. For example, flow control device 280 may be passive components which operate due to flow characteristics of the liquid flowing therethrough, rather than due to external power sources. For example, flow control device 280 may be a pressure compensation flow control valve that alters an inlet flow which is at a variable pressure to an outlet flow at a generally constant pressure with a piston disposed in a cylinder and a spring coupled to the piston. The spring may compress and decompress based on the variable pressure within flow control device 280. As another example, flow control device 280 may include an orifice plate. It should be understood that flow control device 280 is not limited to the above disclosed embodiments. Rather, any suitable apparatus through which liquid at a variable inlet pressure is exhausted at a generally constant outlet pressure is within the scope and spirit of the present disclosure.

The use of a flow control device 280 in dispensing assembly 200 provides advantageous flow characteristics to the liquid flowing from liquid outlet conduit 250 into single serve dispenser module 270. For example, because the liquid flowing from flow control device 280 is at a generally constant pressure, a generally constant backpressure is maintained in dispensing assembly 200. To dispense liquid from liquid outlet conduit 250 into single serve dispenser module 270, inlet valve 236 may be actuated to an open position. Liquid then flowing through dispensing assembly 200 downstream of flow control device 280 may have flow characteristics such that the liquid flows from liquid outlet conduit 250 at a generally constant flow rate. Accordingly, contact time for the liquid in single serve dispenser module 270 may be predictable and may result in increases in single serve beverage quality. Additionally, operation of air pump 292 may not be required to flow water to single serve dispenser module 270 and brew beverages within single serve dispenser module 270, e.g., other than to evacuate residual or remaining liquid water from the container within single serve dispenser module 270.

As may be seen in FIG. 2, dispensing assembly 200 also includes a controller 260. Certain features or components of dispensing assembly 200 and/or refrigerator appliance 100 (FIG. 1) are controlled or operated by controller 260, e.g., according to user preferences selected via manipulation of control panel 140. Control panel 140 is in communication with or coupled to controller 260. In one exemplary embodiment, control panel 140 may represent a general purpose I/O ("GPIO") device or functional block. In another exemplary embodiment, control panel 140 may include input components, such as one or more of a variety of electrical, mechanical or electro-mechanical input devices including rotary dials, push buttons, and touch pads. Control panel 140 may be in communication with controller 260 via one or more signal lines or shared communication busses.

Controller 260 includes memory and one or more processing devices such as microprocessors, CPUs or the like, such as general or special purpose microprocessors operable to execute programming instructions or micro-control code associated with operation of refrigerator appliance 100 and/or dispensing assembly 200. The memory can represent random access memory such as DRAM, or read only memory such as ROM or FLASH. The processor executes programming instructions stored in the memory. The memory can be a separate component from the processor or can be included onboard within the processor. Alternatively, controller 260 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

Controller 260 is also in operative communication with heating element 220, inlet valve 236 and venting valve 242. Controller 260 is configured for selectively activating heating element 220 in order to heat fluid within fluid chamber 212 of tank 210. Controller 260 is also configured for selectively shifting inlet valve 236 between an open configuration and a closed configuration. Inlet valve 236 permits a flow of liquid through inlet conduit 230 into fluid chamber 212 of tank 210 when inlet valve 236 is in the open configuration. Conversely, inlet valve 236 hinders or obstructs the flow of liquid through inlet conduit 230 into fluid chamber 212 of tank 210 when inlet valve 236 is in the closed configuration.

Controller 260 is also configured for selectively switching venting valve 242 between an open configuration and a closed configuration. Venting valve 242 permits a flow of fluid out of fluid chamber 212 of tank 210 through venting conduit 240 when venting valve 242 is in the open configuration. Conversely, venting valve 242 hinders or obstructs the flow of fluid out of fluid chamber 212 of tank 210 through venting conduit 240 when venting valve 242 is in the closed configuration.

Dispensing assembly 200 also includes a temperature sensor 262. Temperature sensor 262 is configured for measuring a temperature of fluids, such as liquid water, within fluid chamber 212 of tank 210. Temperature sensor 262 can be any suitable device for measuring the temperature of fluids. For example, temperature sensor 262 may be a thermistor or a thermocouple. Controller 260 can receive a signal, such as a voltage or a current, from temperature sensor 262 that corresponds to the temperature of fluids within fluid chamber 212 of tank 210. In such a manner, the temperature of fluids within fluid chamber 212 of tank 210 can be monitored and/or recorded with controller 260.

As may be seen in FIG. 2, dispensing assembly 200 further includes an air conduit 290. Air conduit 290 extends to liquid outlet conduit 250. Thus, air conduit 290 may be fluidly coupled to liquid outlet conduit 250 such that a fluid, e.g., air, from air conduit 290 may flow into liquid outlet conduit 250. Air conduit 290 may also extend between venting conduit 240 and liquid outlet conduit 250, as shown in FIG. 2. An air pump 292 is coupled to air conduit 290. Air pump 292 is configured for selectively pumping air into air conduit 290. Thus, air pump 292 may selectively pump air into a flow of liquid within liquid outlet conduit 250 via air conduit 290.

As discussed in greater detail below, air pump 292 may be configured for pumping air into the flow of liquid in liquid outlet conduit 250 when a non-filtered pod is disposed within single serve dispenser module 270. The combined flow of air and liquid may assist with rinsing the non-filtered pod within single serve dispenser module 270. In particular, the air from air pump 292 may generate flow turbulence and increase a pressure of the flow of fluid in liquid outlet conduit 250 when the non-filtered pod is disposed within single serve dispenser module 270, e.g., despite flow control device 280 being disposed upstream of air conduit 290 and/or single serve dispenser module 270. Conversely, air pump 292 may be configured for not pumping air into the flow of liquid in liquid outlet conduit 250 when a filtered pod is disposed within single serve dispenser module 270. Thus, flow control device 280 may operate to provide liquid flow at a generally constant flow rate within liquid outlet conduit 250 when the filtered pod is disposed within single serve dispenser module 270.

An air valve 292 is coupled to air conduit 290. Air valve 292 is configured for regulating a flow of air through air conduit 290 into liquid outlet conduit 250. Air valve 292 can be any suitable mechanism for regulating fluid flow. For example, air valve 292 may be a solenoid valve. Controller 260 is configured for selectively switching air valve 292 between an open configuration and a closed configuration. Air valve 292 permits a flow of air into liquid outlet conduit 250 via air conduit 290 when air valve 292 is in the open configuration. Conversely, air valve 292 hinders or obstructs the flow of air into liquid outlet conduit 250 via air conduit 290 when air valve 292 is in the closed configuration.

Controller 260 may be configured for initiating a non-filtered pod heated water dispense when a non-filtered pod is disposed within single serve dispenser module 270. During the non-filtered pod heated water dispense, controller 260 opens inlet valve 236 such that water flows into fluid chamber 212 of tank 210 via inlet conduit 230 and heated water exits fluid chamber 212 of tank 210 via liquid outlet conduit 250. As discussed above, flow control device 280 may operate to provide liquid flow at a generally constant flow rate within liquid outlet conduit 250 when inlet valve 236 is opened. The liquid supplied to the non-filtered pod disposed within single serve dispenser module 270 may mix with a beverage base (such as powered cocoa or hot chocolate) when the inlet valve 236 is opened. However, the beverage base may clump or otherwise mix incompletely. Thus, controller 260 may also activate air pump 292 and open air valve 294 such that air pump 292 urges air into the water within liquid outlet conduit 250 during the non-filtered pod heated water dispense, e.g., at an end portion of the non-filtered pod heated water dispense. The air from air pump 292 may assist with generating turbulence within the flow of water into the non-filtered pod disposed within single serve dispenser module 270 in order to improved mixing between the heated water and the beverage base and/or rinse the beverage base from the non-filtered pod disposed within single serve dispenser module 270.

Figure 3:
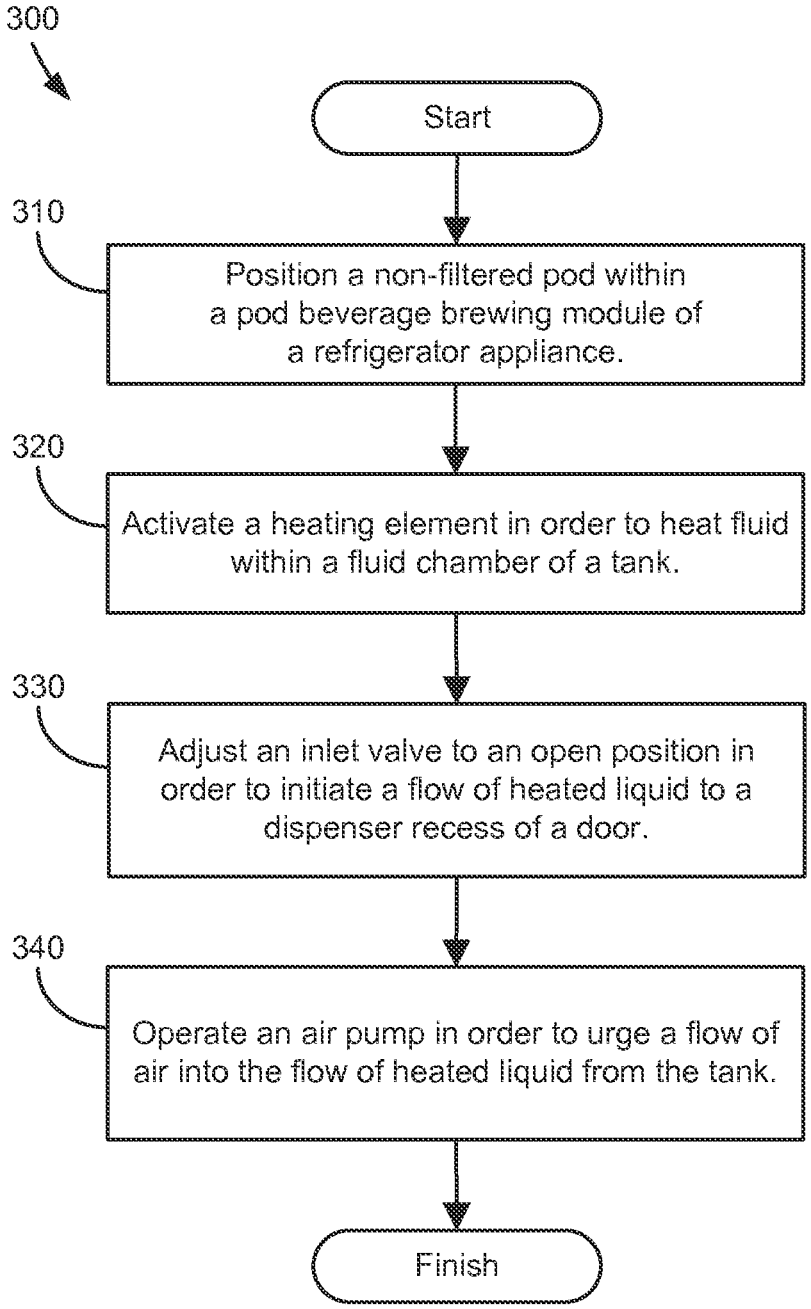
FIG. 3 illustrates a method of operating a dispensing assembly according to an exemplary embodiment of the present subject matter.

FIG. 3 illustrates a method 300 of operating dispensing assembly 200 according to an exemplary embodiment of the present subject matter. Controller 260 may be programmed to implement method 300. Utilizing method 300, controller 260 can provide heated liquid water to single serve dispenser module 270 in a desirable manner. In particular, method 300 may assist with dispensing a beverage from a non-filtered pod disposed within single serve dispenser module 270, as discussed in greater detail below.

As may be seen in FIG. 3, at step 310, a non-filtered pod is positioned within single serve dispenser module 270. As an example, a user of beverage dispenser may load a non-filtered pod into single serve dispenser module 270 at step 310. The single serve dispenser module 270 may pierce the non-filtered pod at step 310, e.g., such that heated water from tank 210 may flow from liquid outlet conduit 250 into the non-filtered pod after step 310. As will be understood by those skilled in the art, a non-filtered pod may contain a beverage base, such as powered chocolate or cocoa, which is mixed with heated water within the non-filtered pod to form the desired beverage. Conversely, a filtered pod includes a filter that retains a beverage base, such as tea leaves or coffee grinds, within the filtered pod after the beverage base is brewed with heated water from liquid outlet conduit 250 with the filtered pod.

At step 320, a heated water dispense signal, e.g., from user interface panel 140 of refrigerator appliance 100, is received at controller 260. As an example, a user of refrigerator appliance 100 may push a button or other suitable input on user interface panel 140 to generate the heated water dispense signal. In particular, after inserting the non-filtered pod into single serve dispenser module 270 at step 310, the user may activate dispensing assembly 200 with the heated water dispense signal at step 320.

At step 330, heating element 220 of dispensing assembly 200 is activated. As an example, controller 260 may activate heating element 220 of dispensing assembly 200 at step 330 in response to receiving the heated water dispense signal at step 320. As another example, heating element 220 of dispensing assembly 200 may be activated at step 330 in order to maintain liquid within fluid chamber 212 of tank 210 at a set temperature. Thus, when temperature measurements from temperature sensor 262 are less than the set temperature, controller 260 may activate heating element 220 of dispensing assembly 200 at step 330 to increase the temperature of liquid in tank 210 to the set temperature. Controller 260 may also open venting valve 242 at step 330, e.g., in order to vent fluid chamber 212 of tank 210 to ambient atmosphere about dispensing assembly 200 and avoid overpressuring tank 210 due to operation of heating element 220. Air valve 294 may be closed at step 330.

At step 340, inlet valve 236 is opened. Thus, a flow of heated water from tank 210 to single serve dispenser module 270 is initiated at step 340, e.g., due to pressurized water flowing into tank 210 via inlet conduit 230, and the heated water flows into the non-filtered pod in single serve dispenser module 270. As an example, controller 260 may open inlet valve 236 at step 340 in response to receiving the heated water dispense signal at step 320, e.g., if controller 260 operates heating element 220 to maintain water within tank 210 at the set temperature. As another example, controller 260 may open inlet valve 236 at step 340 after water within tank 210 is heated to a suitable temperature by heating element 220 at step 330, e.g., if controller 260 activates heating element 220 in response to receiving the heated water dispense signal at step 320.

Controller 260 may close venting valve 242 at step 340 when inlet valve 236 is opened. In addition, air pump 292 may be deactivated and air valve 294 may be closed at step 340, e.g., at a start of a mixing cycle for the non-filtered pod in single serve dispenser module 270. Thus, when heated water from tank 210 first enters the non-filtered pod in single serve dispenser module 270, air pump 292 may be deactivated and air valve 294 may be closed.

At step 350, air pump 292 is operated. As an example, controller 260 may open air valve 294 and operate air pump 292 at step 350 in order to urge or direct a flow of air from air conduit 290 into the flow of heated water from tank 210 within liquid outlet conduit 250. In particular, controller 260 may operate air pump 292 at an end portion of the mixing cycle for the non-filtered pod in single serve dispenser module 270. In particular, controller 260 may activate air pump 292 for no more than the last five seconds or the last three seconds of the mixing cycle for the non-filtered pod in single serve dispenser module 270.

Inlet valve 236 may be open at step 350. Thus, heated water from tank 210 may continue to flow through liquid outlet conduit 250 to single serve dispenser module 270 while air pump 292 is operated at step 350. After step 350, controller 260 may continue to operate air pump 292 for a period of time after closing inlet valve 236. In such a manner, air from air pump 292 may purge residual liquid from the non-filtered pod in single serve dispenser module 270.

By operating air pump 292, method 300 may assist mixing of the beverage base and heated water from tank 210 within the non-filtered pod in single serve dispenser module 270. For example, the air from air pump 292 may generate fluid turbulence within the flow of heated water entering the non-filtered pod in single serve dispenser module 270 and thereby facilitate mixing of the beverage base and heated water. Method 300 may also assist with rinsing the beverage base from non-filtered pod at the end portion of the mixing cycle in order to more fully dispenser the beverage base from the filtered pod within single serve dispenser module 270.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dispenser for a refrigerator appliance, comprising:

a tank;

a heating element configured for heating fluid within the tank;

a liquid inlet conduit extending to the tank, the liquid inlet conduit configured for receiving a flow of liquid and directing the flow of liquid into the tank;

an inlet valve coupled to the liquid inlet conduit, the inlet valve configured for regulating the flow of liquid into the tank via the liquid inlet conduit;

a liquid outlet conduit extending from the tank, the liquid outlet conduit configured for directing the flow of liquid out of the tank;

an air conduit extending to the liquid outlet conduit;

an air pump coupled to the air conduit, the air pump configured for selectively pumping air into the flow of liquid in the liquid outlet conduit;

a pod beverage brewing module coupled to the liquid outlet conduit, the pod beverage brewing module configured to receive a pod with a predetermined amount of a beverage base disposed within the pod an air valve coupled to the air conduit;

a controller operatively coupled to the inlet valve, the air pump and the air valve, the controller configured to activate the air pump and open the air valve during a non-filtered pod heated water dispense when a non-filtered pod is disposed within the pod beverage brewing module, the controller configured to deactivate the air pump and close the air valve during a filtered pod heated water dispense when a filtered pod is disposed within the pod beverage brewing module, wherein the air conduit is coupled to the liquid outlet conduit between an entrance of the liquid outlet conduit and an exit of the liquid outlet conduit, the entrance of the liquid outlet conduit being positioned at the tank such that the entrance of the liquid outlet conduit is in fluid communication with the liquid of the tank, the exit of the liquid outlet conduit being positioned at the pod beverage brewing module such that the exit of the liquid outlet conduit is in fluid communication with the pod beverage brewing module.

2. The dispenser of claim 1, wherein the pod beverage brewing module is coupled to the liquid outlet conduit and is configured for receiving the flow of liquid from the liquid outlet conduit.

3. The dispenser of claim 1, further comprising a venting conduit extending from the tank and a venting valve coupled to the venting conduit, the venting valve configured for regulating a flow of gas out of the tank to ambient atmosphere via the venting conduit.

4. The dispenser of claim 3, wherein the air conduit extends between the venting conduit and the liquid outlet conduit.

5. The dispenser of claim 1, further comprising a flow controller coupled to the liquid inlet conduit, the flow controller configured for reducing a pressure of the flow of liquid in the liquid inlet conduit.

6. The dispenser of claim 5, wherein the flow controller comprises a check valve or au orifice plate.

7. A method for operating a dispenser of a refrigerator appliance, comprising:

receiving a heated water dispense signal at a controller of the refrigerator appliance;

activating a heating element of the dispenser;

positioning a pod within a pod beverage brewing module of the refrigerator appliance, the pod having a predetermined amount of a beverage base disposed within the pod;

opening an inlet valve coupled to a liquid inlet conduit of the dispenser in order to initiate a flow of heated water from a tank of the dispenser through a liquid outlet conduit; and operating an air pump coupled to an air conduit of the dispenser such that the air pump urges a flow of air into the flow of heated water from the tank of the dispenser, wherein the air conduit is coupled to the liquid outlet conduit between an entrance of the liquid outlet conduit and an exit of the liquid outlet conduit, the entrance of the liquid outlet conduit being positioned at the tank such that the entrance of the liquid outlet conduit is in fluid communication with the liquid of the tank, the exit of the liquid outlet conduit being positioned at the pod beverage brewing module such that the exit of the liquid outlet conduit is in fluid communication with the pod beverage brewing module.

8. The method of claim 7, wherein the pod is a non-filtered pod.

9. The method of claim 8, wherein said step of operating the air pump comprises operating the air pump during and at an end portion of a mixing cycle for the non-filtered pod.

10. The method of claim 9, wherein the flow of air and the flow of heated water rinse the non-filtered pod at the end portion of the mixing cycle for the non-filtered pod.

11. The method of claim 9, wherein the air pump is cycled during the mixing cycle for the non-filtered pod.

12. The method of claim 7, wherein the inlet valve is open during said step of operating the air pump.

13. The method of claim 7, wherein a venting valve coupled to a venting conduit that extends from the tank is closed during said step of opening.

14. The method of claim 7, wherein an air valve coupled to the air conduit is open during said step of operating the air pump.

* * * * *